US008640664B2

(12) United States Patent
Lee

(10) Patent No.: US 8,640,664 B2
(45) Date of Patent: Feb. 4, 2014

(54) ENGINE THAT IS EQUIPPED WITH VARIABLE VALVE DEVICE

(75) Inventor: Youngsoo Lee, Seoul (KR)

(73) Assignee: Hyundai Motor Company, Seoul (KR)

( * ) Notice: Subject to any disclaimer, the term of this patent is extended or adjusted under 35 U.S.C. 154(b) by 250 days.

(21) Appl. No.: 12/948,518

(22) Filed: Nov. 17, 2010

(65) Prior Publication Data

US 2012/0067312 A1 Mar. 22, 2012

(30) Foreign Application Priority Data

Sep. 20, 2010 (KR) ..... 10-2010-0092697

(51) Int. Cl.
*F01L 1/14* (2006.01)

(52) U.S. Cl.
USPC ..... 123/90.52; 123/90.44; 123/90.59

(58) Field of Classification Search
USPC ..... 123/90.44, 90.52, 90.55, 90.59
See application file for complete search history.

(56) References Cited

U.S. PATENT DOCUMENTS

| | | | | |
|---|---|---|---|---|
| 4,864,982 | A * | 9/1989 | Speil | 123/90.55 |
| 6,732,687 | B2 | 5/2004 | Djordjevic | |
| 6,769,387 | B2 * | 8/2004 | Hayman et al. | 123/90.39 |
| 7,263,956 | B2 * | 9/2007 | Spath et al. | 123/90.16 |
| 7,568,459 | B2 | 8/2009 | Best | |
| 2002/0014217 | A1 * | 2/2002 | Church et al. | 123/198 F |

FOREIGN PATENT DOCUMENTS

| | | | |
|---|---|---|---|
| JP | 2007-138787 | A | 6/2007 |
| JP | 2009-209879 | A | 9/2009 |
| KR | 1020080023552 | A | 3/2008 |
| KR | 1020090043283 | A | 5/2009 |

* cited by examiner

*Primary Examiner* — Zelalem Eshete
(74) *Attorney, Agent, or Firm* — Morgan, Lewis & Bockius LLP

(57) ABSTRACT

An engine includes a hydraulic pressure lash adjuster (HLA) pivotally supporting an end of a swing arm and having a valve supporting the other end of the swing arm, wherein the hydraulic pressure lash adjuster includes a housing, a plunger of which one end portion thereof may be slidably inserted into the inside of the housing, the other end portion of which extends outwards and supports the end of the swing arm by selectively moving upwards or downwards in a length direction of the housing, a stopper pin slidably mounted in a chamber of the plunger so as to selectively lock the plunger to the housing such that the plunger cannot move in the housing, and a hydraulic pressure supply portion that selectively supplies one side of the stopper pin with a hydraulic pressure in the chamber of the plunger to move the stopper pin toward the housing.

8 Claims, 3 Drawing Sheets

ENGINE THAT IS EQUIPPED WITH VARIABLE VALVE DEVICE

CROSS-REFERENCE TO RELATED APPLICATION

The present application claims priority to Korean Patent Application No. 10-2010-0092697 filed in the Korean Intellectual Property Office Sep. 20, 2010, the entire contents of which is incorporated herein for all purposes by this reference.

BACKGROUND OF THE INVENTION

1. Field of the Invention

The present invention relates to an engine that is provided with a variable valve device that variably controls a motion of a valve disposed at an intake port or an exhaust port of a combustion chamber so as to improve fuel efficiency.

2. Description of Related Art

Some means for varying the timing of valve actuation of internal combustion engines are very well known. Such means typically take the form of a camshaft, a rocker arm, or a finger follower so as to control the valve motion.

A variable valve device is especially well known in spark ignited engines, in which it is an essential element of various schemes for improving fuel economy, and there are methods using a profile of a cam to control a valve lift and using a lost motion so as to control a valve lift.

Meanwhile, a hydraulic pressure lash adjuster (HLA) is used so as to reduce a gap between a valve and a swing arm in a variable valve train, but it is difficult to simply or compactly constitute the variable valve train and the hydraulic pressure lash adjuster in a restricted space.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an engine that is provided with a variable valve device having advantages of realizing a hydraulic lash adjuster having a deactivation function.

In an aspect of the present invention, the engine that may be provided with a variable valve device, may include a hydraulic pressure lash adjuster (HLA) pivotally supporting an end of a swing arm, wherein the hydraulic pressure lash adjuster selectively lifts the end of the swing arm, and a valve supporting the other end of the swing arm, wherein the hydraulic pressure lash adjuster may include a housing, a plunger of which one end portion thereof may be slidably inserted into the inside of the housing, the other end portion of which extends outwards and supports the end of the swing arm by selectively moving upwards or downwards in a length direction of the housing, a stopper pin slidably mounted in a chamber of the plunger so as to selectively lock the plunger to the housing such that the plunger cannot move in the housing, and a hydraulic pressure supply portion that selectively supplies one side of the stopper pin with a hydraulic pressure in the chamber of the plunger to move the stopper pin toward the housing.

A front end portion of the stopper pin may be sequentially inserted into a plunger hole formed at an end portion of the chamber and a housing hole formed in the housing to lock the plunger to the housing, when the hydraulic pressure may be supplied into the chamber from the hydraulic pressure supply portion.

The engine may include an elastic member that may be disposed in the chamber to elastically bias the stopper pin into a central part of the chamber.

The chamber may be formed at a central portion of the plunger, stopper pins may be disposed respectively at both sides of the chamber based on a center of the chamber such that a front end portion of each stopper pin may be selectively engaged with the plunger and the housing, and the hydraulic pressure supply portion supplies the hydraulic pressure into a gap formed between the stopper pins through an oil supply line formed in the housing and the plunger, wherein a lost motion spring may be disposed in a lower chamber of the housing to elastically support the plunger to the outside and wherein an oil bypass passage fluidly connects the oil supply line and the lower chamber.

When the hydraulic pressure supply portion does not supply the chamber with the hydraulic pressure, the stopper pin may be drawn out from a housing hole of the housing and a plunger hole of the plunger by the elastic member such that the plunger returns into the inside of the housing by the swing arm.

The engine may further include a ball that may be formed at an end portion of the plunger to be pivoted in a groove formed in one side of the swing arm.

As stated above, in the engine that may be provided with a variable valve device according to the present invention, a variable valve device may be realized in the hydraulic pressure lash adjuster such that the overall structure becomes small and the component weight may be reduced.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
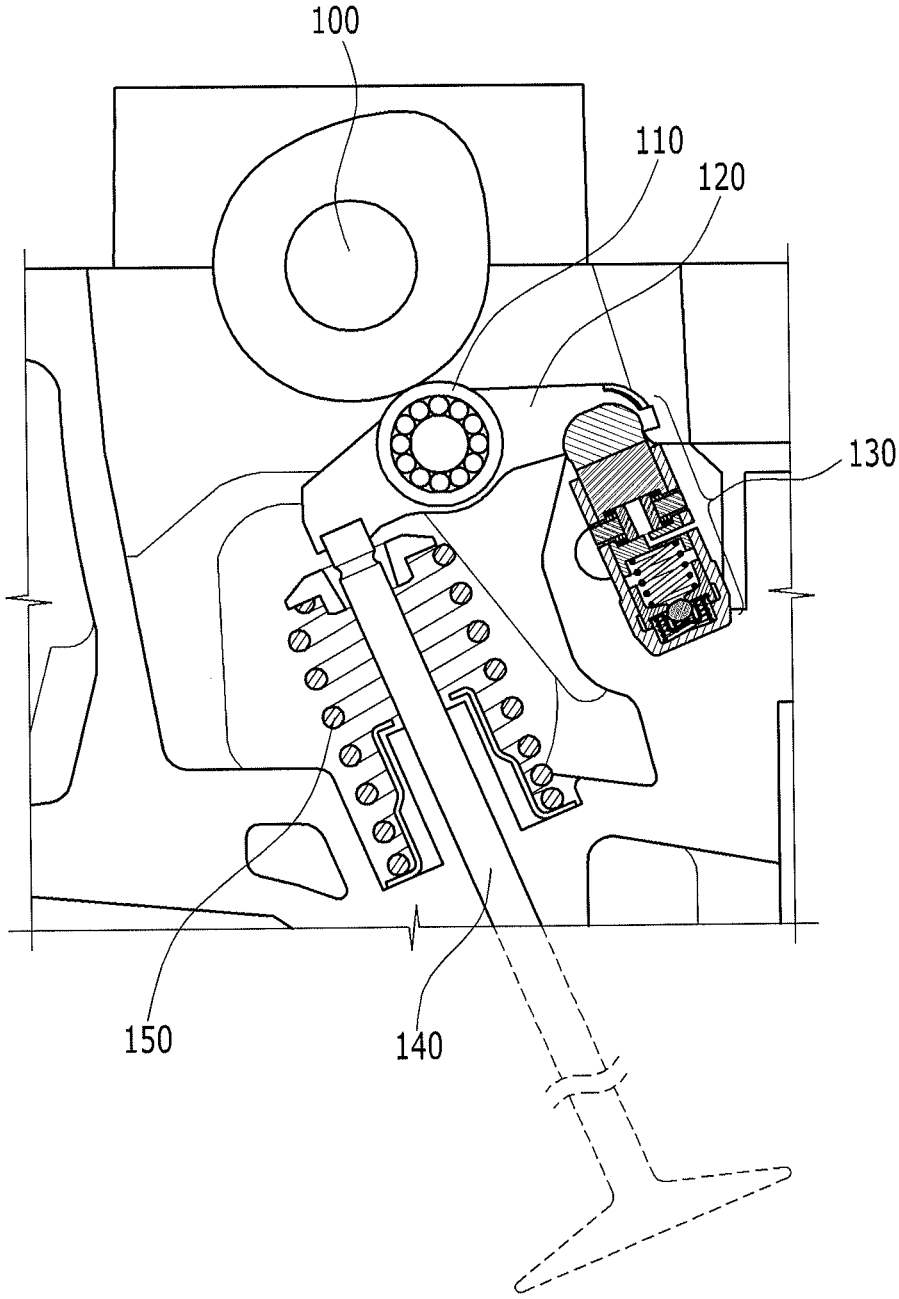
FIG. 1 is a schematic cross-sectional view of an engine that is provided with a variable valve device according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

FIG. 1 is a schematic cross-sectional view of an engine that is provided with a variable valve device according to an exemplary embodiment of the present invention.

Referring to FIG. 1, an engine includes a camshaft 100, a swing arm 120, a roller 110, a hydraulic pressure lash adjuster 130, a valve 140, and a valve spring 150.

A lower portion of one side end of the swing arm 120 is supported by the hydraulic pressure lash adjuster 130, and a lower portion of the other side end of the swing arm 120 is supported by an upper end tip of the valve 140.

The valve spring 150 elastically pulls the valve 140 upwards such that the valve 140 closes an exhaust port or an intake port.

The roller 110 is disposed between the valve 140 and the hydraulic pressure lash adjuster 130 in the swing arm 120, and the roller 110 contacts a cam lobe formed on the cam shaft.

If the camshaft 100 rotates and the cam lobe pushed the roller 110 downwards, the swing arm 120 moves in an anti-clockwise direction based on the hydraulic pressure lash adjuster 130 to push the valve 140 downwards.

Meanwhile, the hydraulic pressure lash adjuster (130, HLA) has a function of CDA (cylinder de-activation) according to an exemplary embodiment of the present invention.

If hydraulic pressure is supplied to the hydraulic pressure lash adjuster 130, the length thereof is sustained and the valve 140 is normally lifted, and if the hydraulic pressure is not supplied to the hydraulic pressure lash adjuster 130, the length of the hydraulic pressure lash adjuster 130 becomes shorter by the swing arm 120 such that the valve 140 does not move or the lift of the valve 140 becomes shorter.

A structure of the hydraulic pressure lash adjuster 130 will be described with reference to a following FIG. 2.

Figure 2:
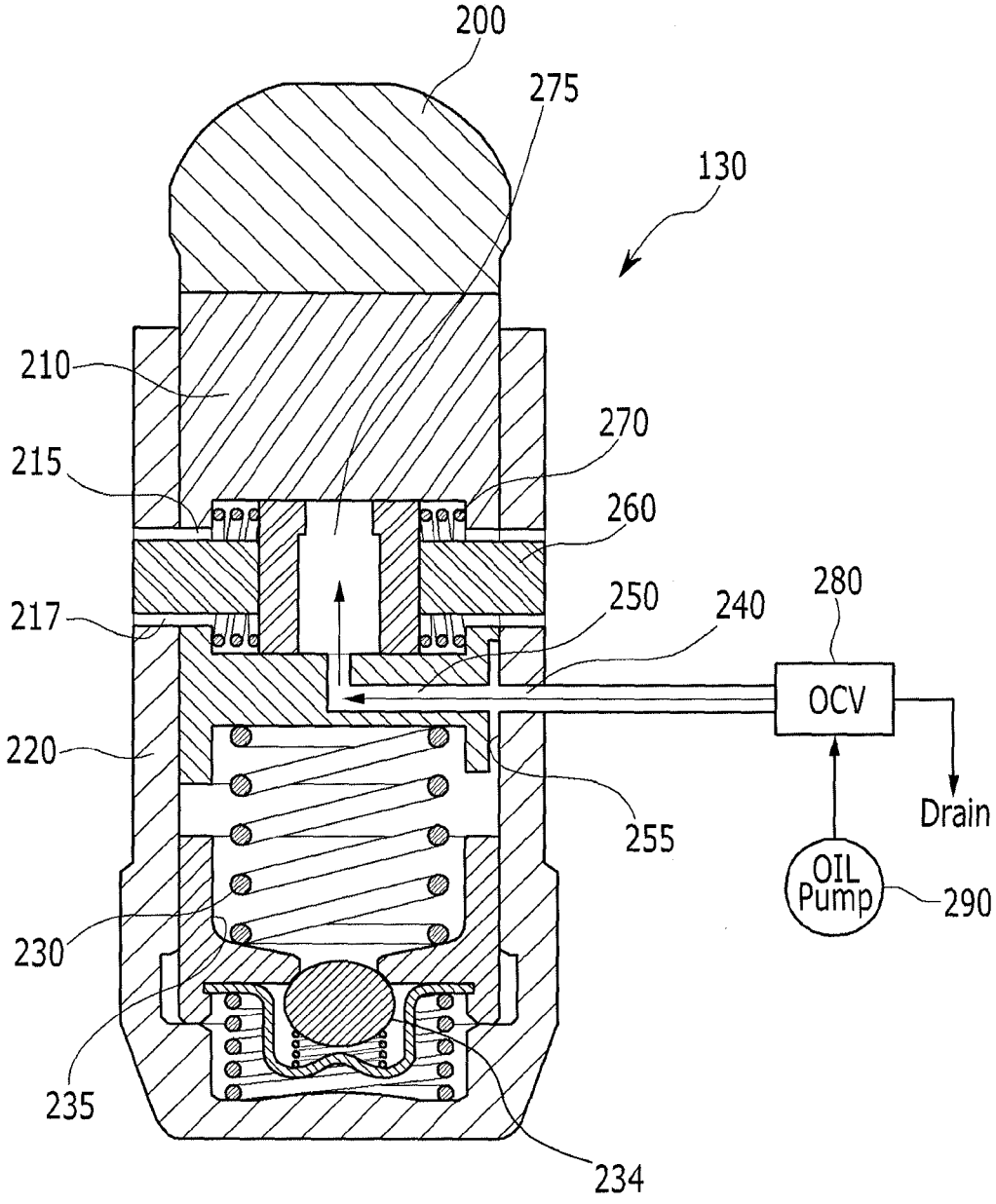
FIG. 2 is a schematic cross-sectional view of a hydraulic pressure lash adjuster in an engine that is provided with a variable valve device according to an exemplary embodiment of the present invention.

FIG. 2 is a schematic cross-sectional view of a hydraulic pressure lash adjuster in an engine that is provided with a variable valve device according to an exemplary embodiment of the present invention.

Referring to FIG. 2, the hydraulic pressure lash adjuster 130 includes a housing 220, a plunger 210, a stopper pin 260, a return spring 270, and a lost motion spring 230, wherein the lost motion spring 230 is retained in a lower chamber 235 formed in a lower portion of the housing 220.

The housing 220 is opened upwards, and a lower portion of the plunger 210 is inserted into the housing 220.

A housing hole 217 is formed at a side surface of the housing 220 in a central direction of the plunger 210, and a plunger hole 215 is formed at the plunger 210 corresponding to the housing hole 217.

A chamber 275 is formed at a central portion of the plunger 210, the chamber 275 is connected to the plunger hole 215, the stopper pin 260 is disposed inside the chamber 275 of the plunger 210, and a front end portion of the stopper pin 260 is disposed through the plunger hole 215 and the housing hole 217.

An oil supply hole 240 and an oil supply line 250 are respectively formed in the housing 220 and the plunger 210 so as to supply the chamber 275 with hydraulic pressure, and the oil supply hole 240 is connected to an oil control valve 280 and a hydraulic pump 290.

The hydraulic pressure supplied from the hydraulic pump 290 is supplied to the chamber 275 through the oil control valve 280, the oil supply hole 240, and the oil supply line 250.

In an exemplary embodiment of the present invention, an oil bypass passage 255 may be formed between the lower chamber 235 and the oil supply line 250 such that the hydraulic pressure supplied to lower chamber 235 lifts the plunger 210 upwards and operates a check ball 234 of the hydraulic pressure lash adjuster.

The hydraulic pressure supplied to the chamber 275 pushes the stopper pin 260 from the center of the plunger 210 to the outside such that the stopper pin 260 is engaged with the plunger hole 215 and the housing hole 217. In this case, a movement of the plunger 210 is prevented in the housing 220.

The return spring 270 is disposed inside the chamber 275, and the return spring 270 elastically pushes the stopper pin 260 from the outside in a central direction of the plunger.

Accordingly, if the hydraulic pressure is not supplied into the chamber 275, the stopper pin 260 is drawn out from the housing hole 217 and the plunger hole 215 by the return spring 270 to move to a central portion of the chamber 275, and the plunger 210 can move upwards and downwards in the housing 220.

Figure 3:
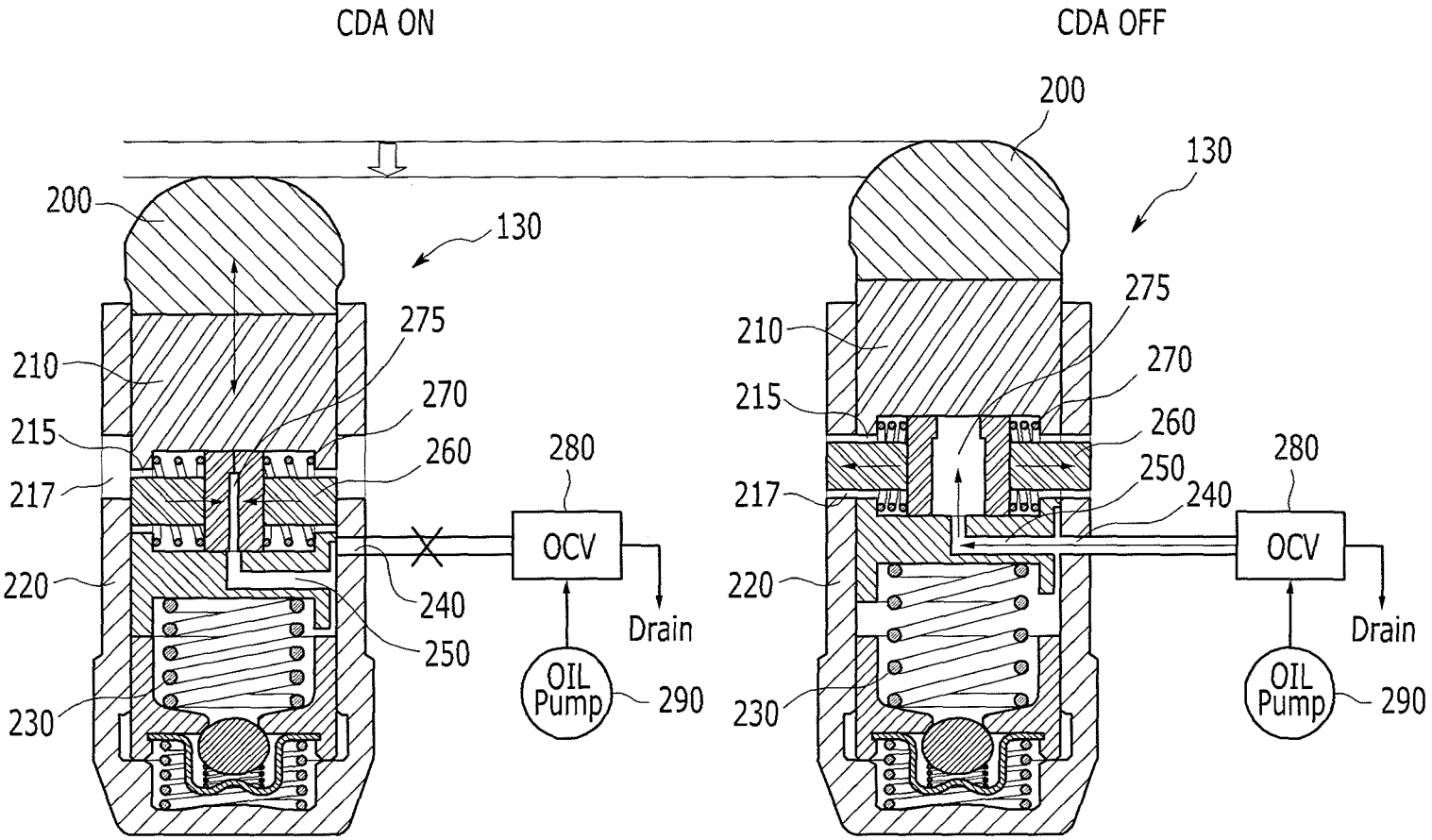
FIG. 3 is a cross-sectional view showing a state in which a hydraulic pressure lash adjuster is operated in an engine that is provided with a variable valve device.

FIG. 3 is a cross-sectional view showing a state in which a hydraulic pressure lash adjuster is being operated in an engine that is provided with a variable valve device.

Referring to FIG. 3, the oil control valve 280 is closed and the hydraulic pressure is not supplied into the chamber 275 in a CDA "ON" condition. Accordingly, the stopper pin 260 moves to a central portion of the plunger 210 by the return spring 270.

In this condition, if a cam lobe of the camshaft 100 pushes the swing arm 120 downwards, the plunger 210 is inserted into the housing 220 and the valve 140 does not move.

When the oil control valve 280 is opened, the hydraulic pressure is supplied into the chamber 275 in a CDA "OFF" condition. Accordingly, the stopper pin 260 overcomes an elastic force of the return spring 270 to move to the outside of the plunger 210, and the stopper pin 260 is inserted into the plunger hole 215 and the housing hole 217.

In this condition, if a cam lobe of the camshaft 100 pushes the swing arm 120 downwards, the plunger 210 supports one side of the swing arm 120 and the other side of the swing arm 120 pushes the valve 140 downwards.

As described above, the hydraulic pressure lash adjuster 130 supports the swing arm 120 and simultaneously has a function of cylinder deactivation (CDA). Thus, a separate CDA device is not necessary such that the space for it is saved and the number of components is reduced. Further, the component weight is reduced, and interference with other components is reduced such that design becomes easier.

Referring to FIG. 1, a curved line type ball 200 is formed at an upper end portion of the plunger 210 corresponding to a lower portion groove of the swing arm 120, and the plunger 210 is engaged with the swing arm 120 to be pivoted through the ball 200.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine that is provided with a variable valve device, comprising:

a hydraulic pressure lash adjuster (HLA) pivotally supporting an end of a swing arm, wherein the hydraulic pressure lash adjuster selectively lifts the end of the swing arm; and a valve supporting the other end of the swing arm;

a cam shaft selectively pushing the swing arm;

wherein the hydraulic pressure lash adjuster comprises:

a housing which is fixed to the engine and having an oil supply hole;

a plunger of which one end portion thereof is slidably inserted into the inside of the housing, the other end portion of which extends outwards and supports the end of the swing arm by selectively moving upwards or downwards in a length direction of the housing;

a stopper pin slidably mounted in a chamber formed inside the plunger so as to selectively lock the plunger to the housing such that the plunger cannot move in the housing;

a hydraulic pressure supply portion that selectively supplies one side of the stopper pin with a hydraulic pressure to move the stopper pin toward the housing, wherein the one side of the stopper pin is continuously disposed inside the chamber;

a lost motion spring that is disposed in a lower chamber of the housing to elastically support the plunger to the outside;

an oil supply line formed inside the plunger and continuously fluid-connected with the oil supply hole of the housing to receive the hydraulic pressure from the hydraulic pressure supply portion; and an oil bypass passage continuously connecting the oil supply line and the lower chamber together.

2. The engine of claim 1, wherein a front end portion of the stopper pin is sequentially inserted into a plunger hole formed at an end portion of the chamber and a housing hole formed in the housing to lock the plunger to the housing, when the hydraulic pressure is supplied into the chamber from the hydraulic pressure supply portion.

3. The engine of claim 2, further comprising an elastic member that is disposed in the chamber to elastically bias the stopper pin into a central part of the chamber.

4. The engine of claim 2, wherein the chamber is formed at a central portion of the plunger, stopper pins are disposed respectively at both sides of the chamber based on a center of the chamber such that a front end portion of each stopper pin is selectively engaged with the plunger and the housing, and the hydraulic pressure supply portion supplies the hydraulic pressure into a gap formed between the stopper pins through the oil supply line.

5. The engine of claim 1, further comprising an elastic member that is disposed in the chamber to elastically bias the stopper pin into a central part of the chamber, and when the hydraulic pressure supply portion does not supply the chamber with the hydraulic pressure, the stopper pin is drawn out from a housing hole of the housing and a plunger hole of the plunger by the elastic member such that the plunger returns into the inside of the housing by the swing arm.

6. The engine of claim 1, further comprising a lost motion spring that is disposed in the lower chamber of the housing to elastically support the plunger to the outside.

7. The engine of claim 5, further comprising an oil bypass passage fluidly connecting the lower chamber and the oil supply line formed in the housing and the plunger.

8. The engine of claim 5, further comprising a ball that is formed at an end portion of the plunger to be pivoted in a groove formed in one side of the swing arm.

* * * * *